US008499580B2

(12) United States Patent
Ikeda et al.

(10) Patent No.: US 8,499,580 B2
(45) **Date of Patent: *Aug. 6, 2013**

(54) AIR CONDITIONER

(75) Inventors: Takashi Ikeda, Chiyoda-ku (JP); Naho Takehara, Chiyoda-ku (JP); Hiroshi Tsutsumi, Chiyoda-ku (JP); Takahiro Yamatani, Chiyoda-ku (JP); Kazunobu Nishimiya, Chiyoda-ku (JP); Yukihiko Kawanori, Chiyoda-ku (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/552,938

(22) Filed: Jul. 19, 2012

(65) Prior Publication Data

US 2012/0325442 A1 Dec. 27, 2012

Related U.S. Application Data

(63) Continuation of application No. 12/529,278, filed as application No. PCT/JP2008/052797 on Feb. 20, 2008, now Pat. No. 8,256,241.

(30) Foreign Application Priority Data

Mar. 14, 2007 (JP) ..... 2007-065337

(51) Int. Cl.
*F25D 17/06* (2006.01)

(52) U.S. Cl.
USPC ..... 62/419; 62/426

(58) Field of Classification Search
USPC .... 62/419, 426, 414, 314, 404, 412; 415/204, 415/211.1, 228; 454/90, 237
See application file for complete search history.

(56) References Cited

U.S. PATENT DOCUMENTS 4,227,868 A 10/1980 Nishikawa et al.
4,397,875 A 8/1983 Gilliom (Continued)

FOREIGN PATENT DOCUMENTS

EP 0 942 175 A1 9/1999
JP 52-094639 A 8/1977

(Continued)

OTHER PUBLICATIONS

Form PCT/ISA/210 of Application No. PCT/JP2008/052797 dated Apr. 22, 2008.

(Continued)

*Primary Examiner* — Mohammad M Ali
(74) *Attorney, Agent, or Firm* — Buchanan Ingersoll & Rooney PC

(57) ABSTRACT

A centrifugal fan mounted in an air conditioner has the following relationship: outer diameter of a side plate of the centrifugal fan>outer diameter of the blade rear-edge part on side-plate side>diameter of the blade rear-edge part on main plate side>outer diameter of the main plate. In the centrifugal fan, the blade rear-edge part is positioned inside from a straight line connecting the connection point between the blade rear-edge part and the main plate, to the connection point between the blade rear-edge part and the side plate, as viewed from the rotation axis. The blade rear-edge part has a shape such that the distance from the rotation axis becomes larger from the main plate toward the side plate.

12 Claims, 17 Drawing Sheets

U.S. PATENT DOCUMENTS

| | | | | |
|---|---|---|---|---|
| 5,029,810 | A * | 7/1991 | Finnerty | 251/299 |
| 6,093,096 | A | 7/2000 | Miyata et al. | |
| 6,095,099 | A | 8/2000 | Morohoshi et al. | |
| 6,141,217 | A | 10/2000 | Nakahama et al. | |
| 6,142,864 | A | 11/2000 | Uemura et al. | |
| 6,345,667 | B1 * | 2/2002 | Hata et al. | 165/200 |
| 6,345,956 | B1 | 2/2002 | Lin | |
| 6,370,907 | B1 * | 4/2002 | Sekiguchi et al. | 62/426 |
| 6,372,005 | B1 | 4/2002 | Fiacco | |
| 6,393,856 | B1 * | 5/2002 | Gunji et al. | 62/298 |
| 6,551,074 | B2 | 4/2003 | Kudo et al. | |
| 6,610,118 | B2 | 8/2003 | Bryce et al. | |
| 6,616,422 | B2 * | 9/2003 | Hsieh | 417/354 |
| 6,893,218 | B2 * | 5/2005 | Ito | 415/198.1 |
| 6,926,498 | B2 * | 8/2005 | Li et al. | 416/3 |
| 6,971,846 | B2 | 12/2005 | Ochiai et al. | |
| RE39,117 | E * | 6/2006 | Matsumoto | 417/423.15 |
| 7,063,515 | B2 | 6/2006 | Graber et al. | |
| 7,066,712 | B2 * | 6/2006 | Kim et al. | 415/58.4 |
| 7,185,504 | B2 * | 3/2007 | Kasai et al. | 62/186 |
| 7,191,613 | B2 | 3/2007 | Lee | |
| 7,331,758 | B2 | 2/2008 | Arinaga et al. | |
| 7,461,518 | B2 * | 12/2008 | Higashida | 62/419 |
| 7,473,078 | B2 | 1/2009 | Hisaka et al. | |
| 7,614,250 | B2 * | 11/2009 | Sanagi | 62/426 |
| 2003/0039548 | A1 | 2/2003 | Kim | |
| 2007/0113527 | A1 * | 5/2007 | Song et al. | 55/471 |

FOREIGN PATENT DOCUMENTS

| | | | |
|---|---|---|---|
| JP | 53-093407 | A | 8/1978 |
| JP | 58-129426 | U | 9/1983 |
| JP | 60-151014 | U | 10/1985 |
| JP | 61-175419 | A | 8/1986 |
| JP | 2-136597 | A | 5/1990 |
| JP | 4-263710 | A | 9/1992 |
| JP | 4-263715 | A | 9/1992 |
| JP | 5-039930 | A | 2/1993 |
| JP | 7-004389 | A | 1/1995 |
| JP | 07-145955 | A | 6/1995 |
| JP | 2706383 | B2 | 1/1998 |
| JP | 2000-054994 | A | 2/2000 |
| JP | 2000-146214 | A | 5/2000 |
| JP | 2003-065291 | A | 3/2003 |
| JP | 2003-262357 | A | 9/2003 |
| JP | 2003-287239 | A | 10/2003 |
| JP | 2004-092950 | A | 3/2004 |
| JP | 2004-204756 | A | 7/2004 |

OTHER PUBLICATIONS

Non-English version of Form PCT/ISA/237 of Application No. PCT/JP2008/052797dated Apr. 22, 2008.

English translation of the Notification of Transmittal of Translation of the International Preliminary Report on Patentability (Forms PCT/IB/338 and PCT/IB/373) and Written Opinion of the International Searching Authority (Form PCT/ISA/237).

Official Action dated Sep. 13, 2010, issued in the corresponding Chinese Patent Application No. 200880007861.5.

Office Action from British Intellectual Property Office issued in corresponding British Patent Application No. 0913767.0 dated Jul. 1, 2011.

Office Action (Examination Report) dated Nov. 2, 2011, issued in the corresponding United Kingdom Patent Application No. GB0913767.0.

Office Action (Examination Report) dated Mar. 13, 2012, Issued in the corresponding Spanish Patent Application No. 200990016, and an English Translation thereof. (8 pages).

Notice of Reasons for Rejection issued on Feb. 5, 2013 by the Japanese Patent Office in corresponding Japanese Patent Application No. 2011-262672, and an English translation thereof.

* cited by examiner

9

(b) — (b)

(a) MOVEMENT OF MOLD (b) RESIN INJECTION STAGE (c) RESIN COOLING STAGE (d) MOLD RELEASE STAGE (e) MOLDED COMPONENT TAKING-OUT STAGE k 1 − k 2 − k 3 − k 4

AIR CONDITIONER

TECHNICAL FIELD

The present invention relates to an air conditioner of which the body is installed in a space behind a ceiling and which performs cooling, heating, dehumidification, air cleaning, and humidification.

BACKGROUND ART

For example, in an air conditioner set forth in Patent Document 1, a ceiling surface suction port for sucking indoor air in a room into a space behind the ceiling, is provided in a position apart from the air conditioner body in the ceiling, and a body suction port is provided in a side wall of the body. A filter is arranged on the body suction port, and behind the body suction port, a heat exchanger is arranged so as to be opposed thereto. A blower is arranged in a space surrounded by an airflow guide plate and a ceiling panel. In the ceiling panel mounted under the body, a ceiling panel blowoff port is provided alone.

By such arrangements, since the ceiling surface suction port into which air in the room is sucked is spaced apart from the ceiling panel blowoff port, the short cycle phenomenon that a part of flow from the blowoff port is directly sucked into the suction port, is prevented from occurring, thereby allowing the indoor temperature to be uniformized. Furthermore, since the space behind the ceiling can be used as a flow path for sucked air, there is no need for a duct, so that it is possible to reduce costs of facilities and construction costs, and to decrease a flow path resistance. Moreover, if, as a blower, a centripetal fan is used instead of a centrifugal fan, the fan can be placed in a space surrounded by the heat exchanger, thereby allowing the airflow guide plate to be omitted.

[Patent Document 1] Japanese Patent No. 2706383

DISCLOSURE OF INVENTION

Problems to be Solved by the Invention

The conventional air conditioner is configured as described above. However, when a centrifugal fan in which the outer diameter of a main plate and that of a side plate is substantially the same is used for a blower, the direction of blowoff air from the centrifugal fan is a horizontal direction perpendicular to an axis, so that, when the centrifugal fan is installed within the air conditioner body, blowoff flow on the side-plate side and that on the main plate side interfere with each other to thereby enhance a draft resistance and increase noises. As a result, it is necessary for the fan to be installed so as to protrude downward from the air conditioner body. It is required, therefore, that the ceiling panel is installed in a state of protruding from the ceiling surface, which makes the size reduction of the apparatus difficult.

If suction distance between a body top plate and the suction port of the centrifugal fan is too small, the draft resistance is increased, and due to the difference in flow speed between the vicinity of the baffle plate and the body top plate side, drifts occur, so that suction flow is disturbed increasing noises. On the other hand, if the above-described suction distance is too large, the body height becomes undesirably large.

In the case where the body and the ceiling panel are separate ones before installing, since the centrifugal fan is arranged in a state of protruding from the body, the centrifugal fan suffers damage during transportation. In addition, in order to prevent the damage thereto, a large amount of packing materials are needed around the fan protruding from the body, which is unfavorable to environment.

The present invention has been made in order to solve the problems as described above, and the object of the present invention is to obtain an air conditioner that is high in product reliability and handling properties during transportation, and low in noise, that gives no feeling of oppression to residents, and that can be packed with a small amount of packing materials, compared with conventional air conditioners.

Means for Solving the Problems

The air conditioner according to the present invention comprises:

a body that, in use, is situated in a ceiling of a room to be air-conditioned, the body including a ceiling panel having a body blowoff port for supplying air from the inside of the body, a side wall installed in an upright position along the outer periphery of the ceiling panel and having at least one body suction port formed therein, and a top plate provided so as to cover a surface opposed to the ceiling panel with respect to the side wall;

a heat exchanger provided in the vicinity of the body suction port inside the body;

a fan motor fixed to the top plate, the fan motor having a rotation shaft;

a fan that is fixed onto the rotation shaft of the fan motor, sucks the air sucked via the body suction port and the heat exchanger, and guides the air from a rotation center toward an outside in an obliquely downward direction to blow off the air into the room; and a airflow guide plate that isolates an air flow on the suction side of the fan from an air flow on the blowoff side thereof, and that guides a blowoff flow of the fan to the blowoff port of the ceiling panel, the airflow guide plate including a bell mouth and an airflow guide part formed into a truncated cone shape.

Advantages

The air conditioner according to this invention contributes to effects that are high in product reliability and transportability during transportation, and low in noise, that gives no feeling of oppression to residents, and that can be packed with a small amount of packing materials, compared with conventional air conditioners.

REFERENCE NUMERALS

Figure 1:
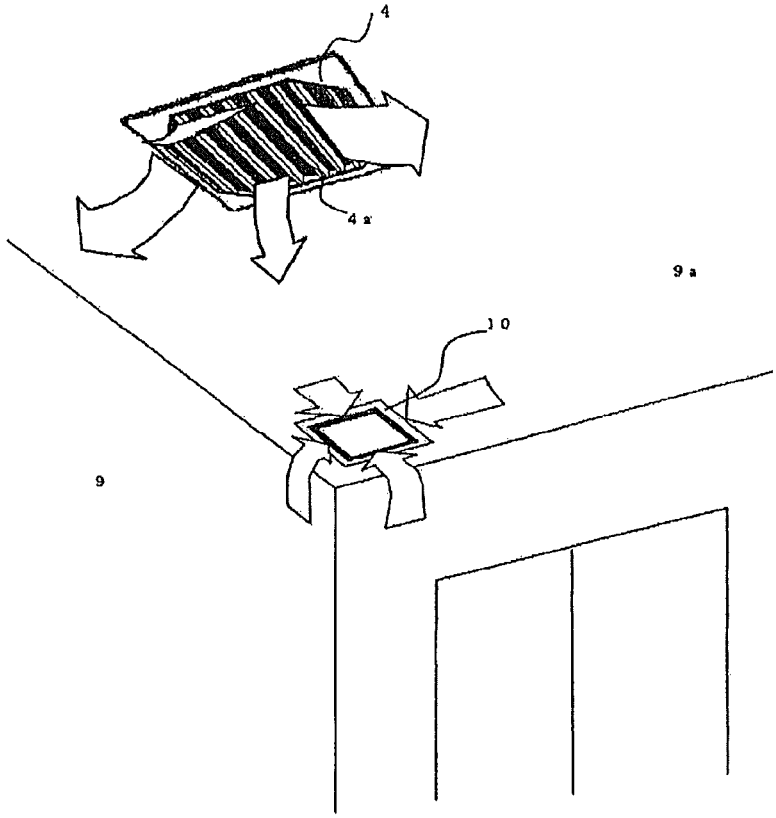
FIG. 1 is a diagram showing an installation state of an example of an air conditioner according to a first embodiment of the present invention, as viewed from a room.

1 air conditioner body
1*a* body side-plate side suction port
1*b* body side-wall
1*c* body top plate
1*d* body top plate side suction port
2 dust removal filter
2*a* air cleaning filter
2*b* humidifying filter
3 heat exchanger
3*a* additional heat exchanger
4 body panel
4*a* body panel blowoff port
4*b* central panel
4*c* body panel central opening
5 drain pan
6 airflow guide plate
6*a* bell mouth
6*b* airflow guide plate blowoff port
6*c* airflow guide part
7 fan motor
8 centrifugal fan
8*a* fan suction port
8*b* fan blowoff port
9 room
9*a* ceiling
9*b* space behind ceiling
10 ceiling suction port
11 side plate
11*a* side plate suction part
11*b* airflow guide wall
11*c* side plate recess part
11*d* side plate inner periphery front end part
12 main plate
12*a* boss
13 blade
13*a* blade front edge part
13*b* blade rear edge part
13*c* step formed by thickness difference between inner and outer peripheral side blade parts 13*e* and 13*d* at a blade dividing line B.
13*d* outer peripheral side blade part located on the outer peripheral side of the blade dividing line B
13*e* inner peripheral side blade part located on the inner peripheral side of the blade dividing line B.
13*as* blade front-edge part side-plate side connection
13*bm* blade rear-edge part main plate side connection
13*bs* blade rear-edge part side-plate side connection 13*s* warped line
14*a* and 14*b* molds
15 electrical component box 15*a* electrical substrate
16 humidification tank
200 air conditioner body
201 ceiling surface suction port
202 body side-wall
202*a* body suction port
203 filter
204 heat exchanger
205 airflow guide plate
206 blower
207 ceiling panel
207*a* ceiling panel blowoff port
208 ceiling
209 room
210 space behind ceiling

BEST MODES FOR CARRYING OUT THE INVENTION

First Embodiment

Hereinafter, an air conditioner according to a first embodiment of the present invention will be described with reference to FIGS. 1 to 11.

Figure 2:
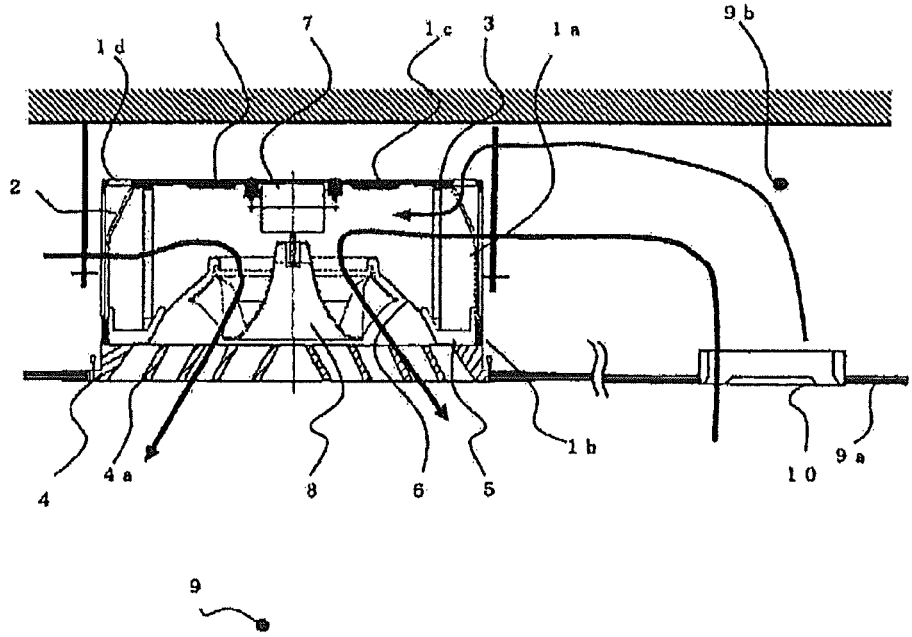
FIG. 2 is a longitudinal sectional view of the air conditioner in its installation state.
Figure 3:
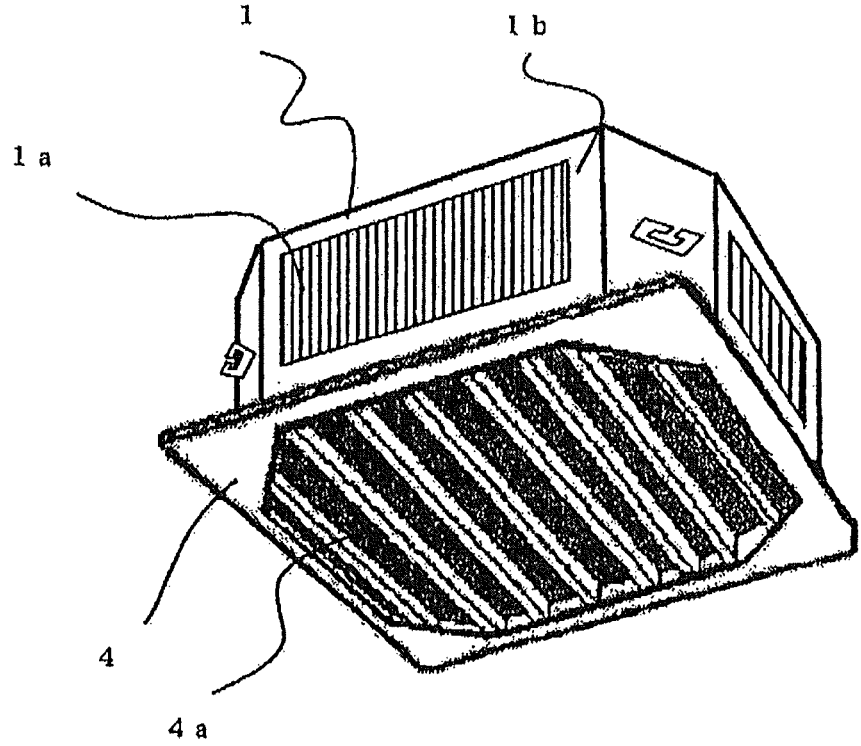
FIG. 3 is a perspective view of an air conditioner body and a ceiling panel at the time of installation.
Figure 4:
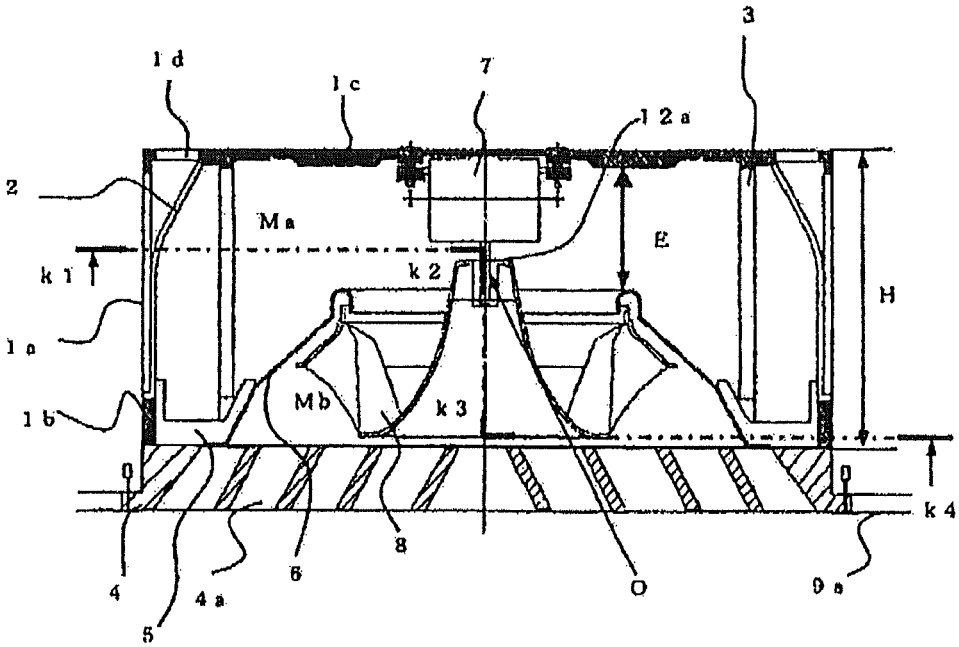
FIG. 4 is a longitudinal sectional view of the air conditioner in FIG. 2.
Figure 5:
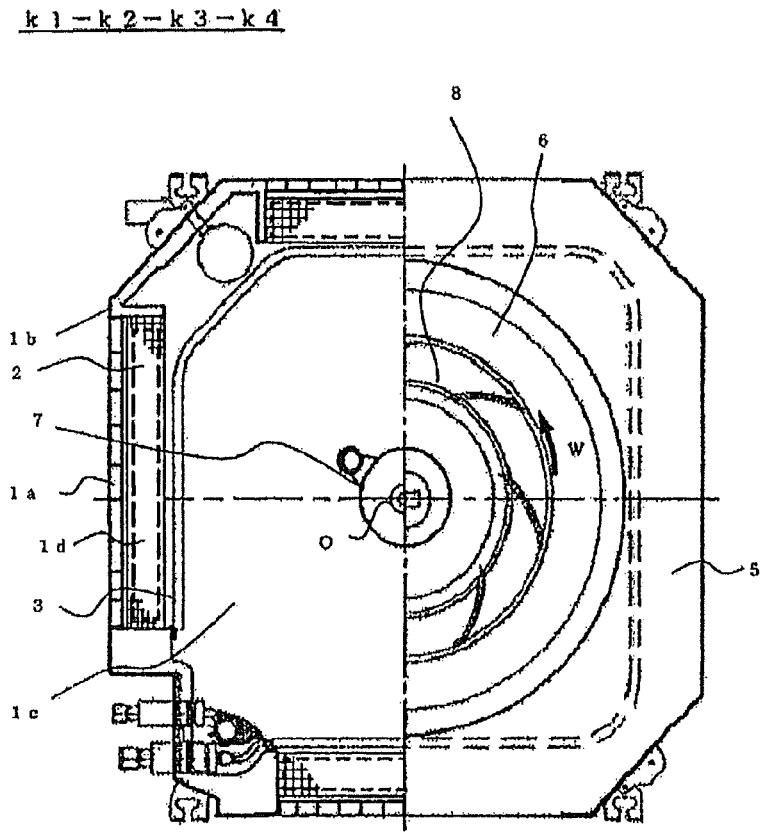
FIG. 5 is a horizontal sectional view taken along section indicating lines k1 to k4 in FIG. 4.
Figure 6:
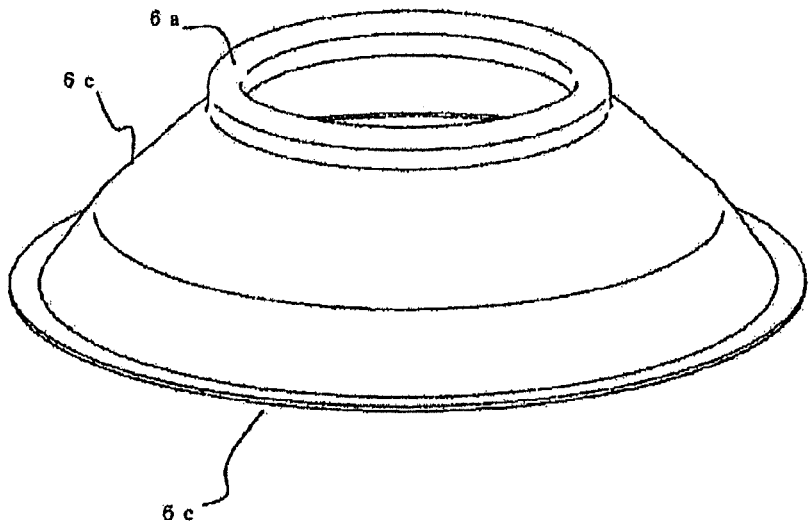
FIG. 6 is a perspective view of an airflow guide plate.
Figure 7:
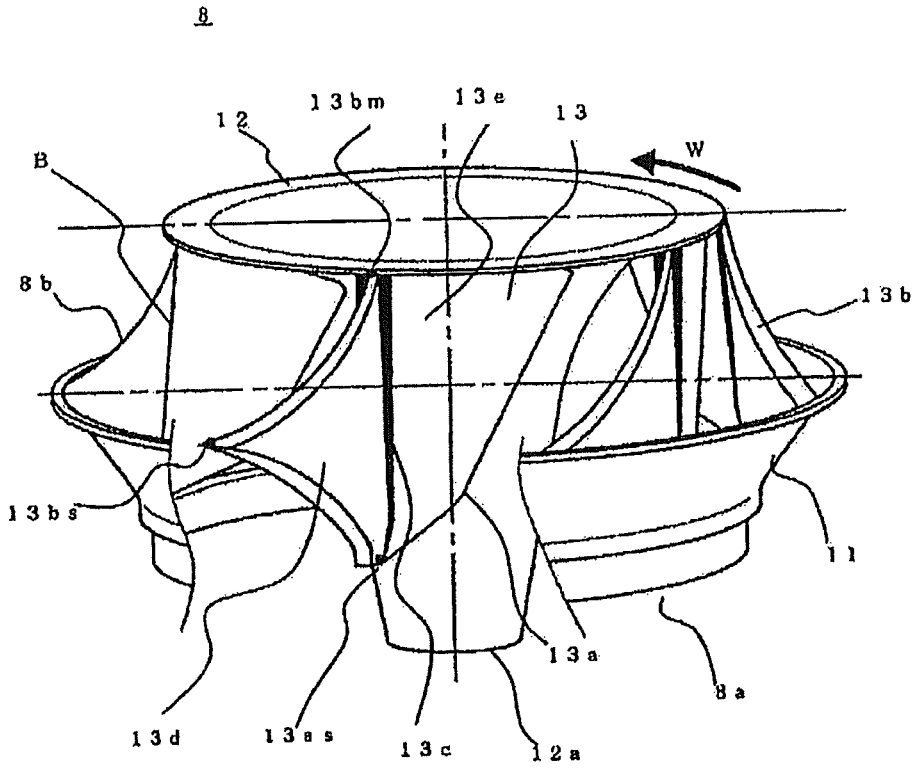
FIG. 7 is a perspective view of a centrifugal fan as viewed from its main plate side.
Figure 8:
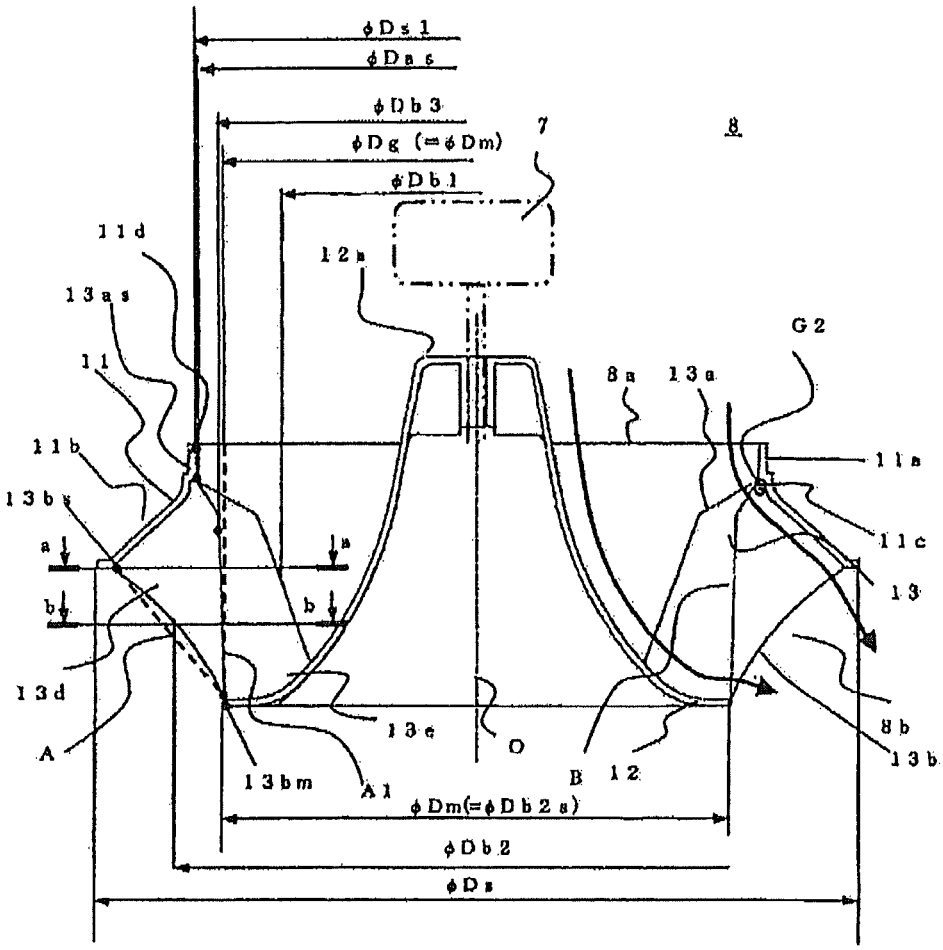
FIG. 8 is a longitudinal section projection view corresponding to FIG. 7.
Figure 9:
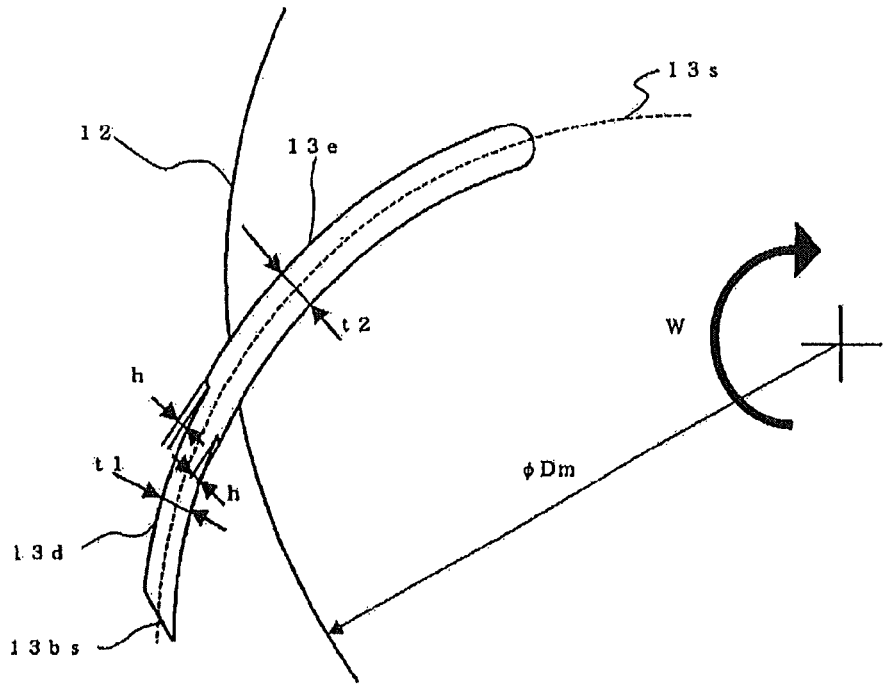
FIG. 9 shows a blade sectional view taken along a line a-a in FIG. 8, and its partially enlarged view.
Figure 10:
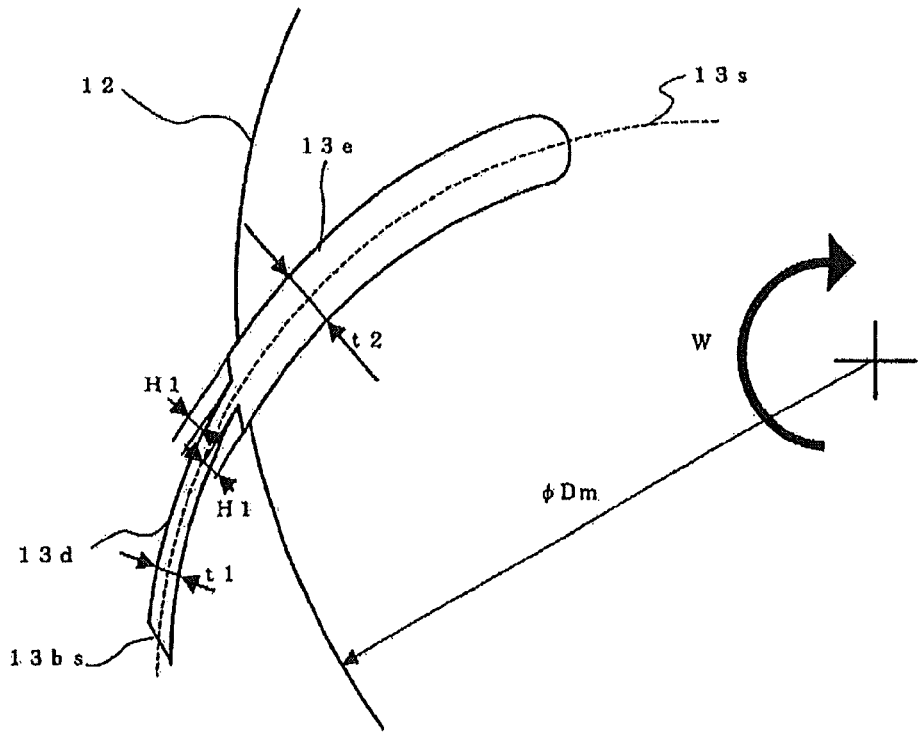
FIG. 10 shows a blade sectional view taken along a line b-b in FIG. 8, and its partially enlarged view.
Figure 11:
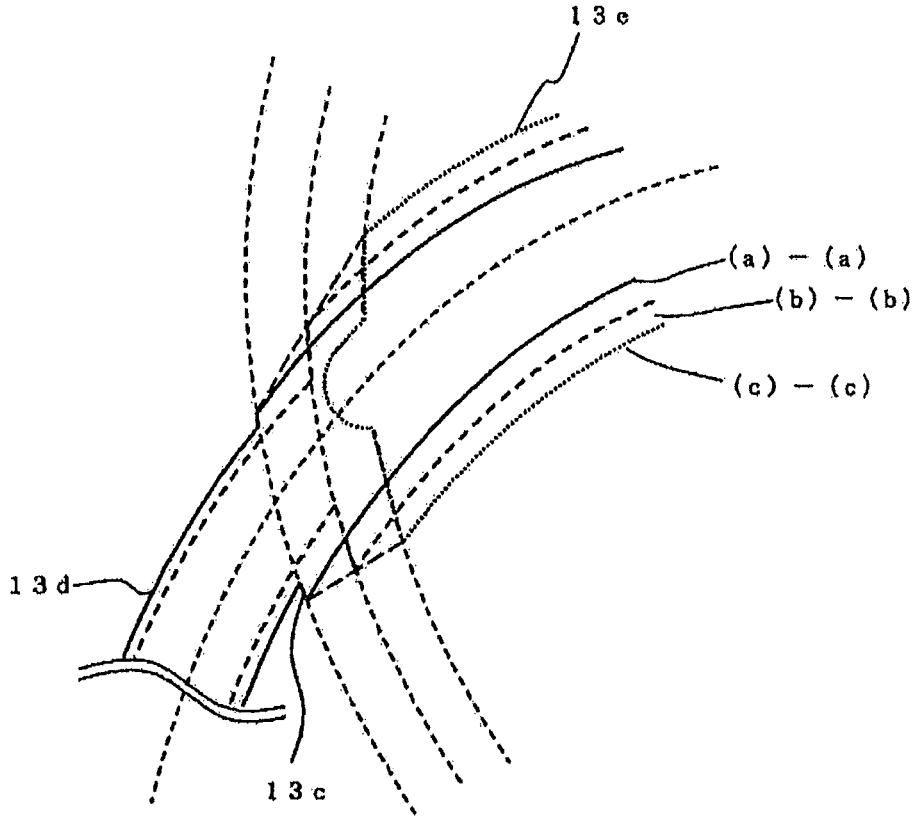
FIG. 11 is a diagram showing the change in the wall thickness of a blade section.

FIG. 1 shows a diagram showing the air conditioner according to the first embodiment of the present invention, as its installation state is viewed from a room; FIG. 2 is a longitudinal sectional view of the air conditioner in the installation state; FIG. 3 is a perspective view of an air conditioner body and a ceiling panel at the time of installation; FIG. 4 is a longitudinal sectional view of the air conditioner in FIG. 2; FIG. 5 is a horizontal sectional view taken along section indicating lines k1 to k4 in FIG. 4; FIG. 6 is a perspective view of an airflow guide plate; FIG. 7 is a perspective view of a centrifugal fan as viewed from its main plate side; FIG. 8 is a longitudinal section projection view corresponding to FIG. 7; FIG. 9 shows a blade sectional view taken along a line a-a in FIG. 8, and its partially enlarged view; FIG. 10 shows a blade sectional view taken along a line b-b in FIG. 8, and its partially enlarged view; and FIG. 11 is a diagram showing the change in the wall thickness of a blade section.

As shown in FIGS. 1 and 2, at a position apart from a body panel 4 in a ceiling 9*a*, there is provided a ceiling suction port 10 for sucking indoor air in a room 9 to a space 9*b* behind the ceiling, and under an air conditioner body 1, the body panel 4 facing the ceiling 9*a* is opposed to the room 9. A body panel blowoff port 4*a* is formed into grid shape, and installed under the air conditioner body 1 so as to be substantially flush with the room-side surface of the ceiling 9.

As illustrated in FIG. 2 or 4, there are provided a body side-plate side suction port 1*b* formed on each surface of body side wall 1*b* of the air conditioner body 1, and a body top plate side suction port 1*d* formed in the body top plate 1*c* along the side wall 1*b*. A dust removal filter 2 is provided so as to completely cover the body-side plate side suction port 1*a* and the body top plate-side suction port 1*d*. Here, it is only necessary for the body-side plate side suction port 1*a* to have an opening in at least one surface of the body side-wall 1*b*. Also, if the body-side plate side suction port 1*a* has an opening, there is no need for a body top plate-side suction port 1*d*.

As shown in FIGS. 4 and 5, inside the body side-wall 1*b*, a heat exchanger 3 in a substantially square shape is installed in an upright position, substantially along the body side plate side suction port 1*a*. A side plate 11 of a centrifugal fan 8 has a straight-pipe shape side plate suction port 8*a* constituting a fan suction port 8*a*, and an airflow guide wall 11*b* for guiding air that has been sucked inside a fan of the side plate 11, to the blowoff port. In the vicinity of the side plate 11, there is an airflow guide plate 6 provided so as to completely isolating a fan suction air path Ma from a blowoff air path Mb. The airflow guide plate 6 has a configuration in which a bell mouth 6*a* that is formed so as to cover a side plate suction part 11*a* plate suction part 11*a* substantially in parallel thereto and that is installed a predetermined distance apart from the body top plate 1*c*, is integrated into one unit with an air guide part 6*c* that is formed along the surface of the air guide wall 11*b* substantially in parallel thereto to guide a blowoff flow of the centrifugal fan 8 from the airflow guide plate blowoff port 6*b* to the outside of the air conditioner body via the blowoff port of the body panel 4. By virtue of the bell mouth 6*a*, the centrifugal fan 8 on the suction side does not become exposed, and the rotation of the centrifugal fan 8 does not affect air flow on the suction side, so that the flow on the suction side is rectified and air is efficiently sucked into the centrifugal fan 8. Furthermore, as shown in FIGS. 4 and 6, the airflow guide part 6*c* is configured so as to gradually enlarge from the fan blowoff port 8*b* toward the airflow guide plate blowoff port 6*b* into a truncated cone shape. The airflow guide plate 6 is arranged so as to be prevented from coming in contact with the centrifugal fan 8, and it is fixed to a drain pan 5, with screws or an adhesive. Alternatively, the airflow guide plate 6 may be formed integrally with the drain pan 5.

A fan motor 7 is provided to the body top plate 1*c*, and the rotational shaft of the fan motor 7 is securely inserted into a boss 12*a* of the centrifugal fan 8. The centrifugal fan 8 is installed in a space surrounded by the airflow guide plate 6 and the body panel 4. Furthermore, there is provided a drain pan 5, which is molded of a foam material and capable of heat insulation, for temporarily storing condensed water produced in the heat exchanger 3 at the time when the heat exchanger 3 is cooled to perform a cooling operation.

FIG. 8 shows positional relationship of the centrifugal fan with respect to the fan motor 7 at the time when they are mounted in the air conditioner. FIG. 8 is shown upside down with respect to FIG. 7. As shown in FIGS. 7 and 8, the centrifugal fan 8 includes: a main plate 12 having a flat part provided on the outer peripheral side thereof, and a convex-shaped boss part that is provided at the central part thereof, as a fixed part to the rotation shaft of the motor;

a plurality of blades 13 installed in an upright position on the main plate 12 in substantially parallel to a rotation axis 0; and a ring-shaped side plate 11 having airflow guide wall provided so as to surround the boss part with a predetermined distance therebetween. As shown in FIG. 9, the blades 13 each have a two-dimensional wing shape in which a warped line 13*s* indicating a blade wall thickness center line is mutually equal in the rotational axis direction. As a result of the rotation of the blades 13, the centrifugal fan sends air from a suction port formed by the boss-side wall surface of the main plate 12 and the end part of the side plate 11 opposite to the boss-side wall surface, toward a blowoff port formed by the outer peripheral side flat part of the main plate 12 and a side plate end part opposite to the outer peripheral side flat part. Hereinafter, a blade edge part located on the downstream side of a blowing direction is referred to as a blade rear edge part.

Here, the side plate outer diameter ϕDs, the main plate outer diameter ϕDm, and the blade rear edge part main-plate side outer diameter ϕDb2*m* of the centrifugal fan 8 have the following relationship among them:

side plate outer diameter ϕDs<main plate outer diameter ϕDm=blade rear edge part main-plate side outer diameter ϕDb2*s*.

Furthermore, the relationship: the main plate outer diameter ϕDm<fan suction port diameter ϕDs1 is satisfied, and the outer diameter ϕDb2 of the blade 3 and the inner diameter ϕDb1 thereof are configured to become larger from the main plate 12 side toward the side plate 11 side, in the rotation axis direction.

Moreover, the blade rear-edge part 13*b* is positioned on the inside of the fan from a blade outlet representative line A, which is a straight line connecting the connection point between the blade rear-edge part and the main plate 12, i.e., a blade rear-edge part main-plate side connection point 13*bm*, and the connection point between the blade rearedge part and the side plate, i.e., a blade rear-edge part side-plate side junction 13*bs*, and the blade rear-edge part 13*b* has a shape such that the distance from a rotation axis 0 becomes larger from the main plate toward the side plate.

As show in FIG. 9, the blade shape is configured • to be a concave curved shape that at least obliquely extends outside an impeller with respect to a blade outlet tilt reference line A1 that is a straight line passing through the blade rear-edge part main-plate side junction 13*bm* in parallel to the rotation axis O.

Regarding diameters on planes perpendicular to the rotation axis, at the blade rear-edge part main-plate side connection point 13*bm*, and a blade front-edge part sideplate side connection point 13*as*, with the rotation axis as their center, let the blade rear-edge part main-plate side diameter be ϕDb2*m*, and let the blade leading-edge part sideplate side diameter be ϕDas1. Then, the relationship: ϕDb2*m*<ϕDas1 holds, resulting in a blade shape in which the diameter become gradually larger from the main plate 12 toward the side plate 11. Also, when a fan suction port diameter, which is a diameter of the side plate front end part 11*d* with the rotation axis as its center, is denoted by ϕDs1, the relationship: ϕDas1<ϕDs1 holds.

On a surface of the blade, a blade dividing line B is provided that shows a diameter becoming gradually larger from the main plate 12 through the blade rear-edge-part main plate side connection point 13*bm* and the blade front-edgeside plate side junction 13*as* toward the side plate 11 in the rotation axis direction, at least within a range meeting the condition:

the blade rear-edge part main-plate side diameter ϕDb2*m*<the blade front-edge part side-plate side diameter ϕDas1.

As illustrated in FIG. 9, in the section taken along a line a-a, there is not so large a step 13*c* between the outer peripheral blade part 13*d* and the inner peripheral side blade part 13*e*, while in the section taken along a line b-b shown in FIG. 10, the step 13*c* between the outer peripheral blade part 13*d* and the inner peripheral side blade part 13*e* is larger than that in the case in FIG. 9.

As shown in FIG. 11, the wall-thickness t1 of the outer peripheral blade part 13*d* on the outer peripheral side from the blade dividing line B becomes gradually larger from the main plate 12 toward the side plate 11, that is, from the section taken along the line c-c toward the section taken along the line a-a. Conversely, the wall-thickness t2 of the inner peripheral side blade part 13*e* on the inner peripheral side from the blade dividing line B becomes gradually smaller from the main plate 12 toward the side plate 11. The blade shape is configured so that, in the rotation axis direction, at least under the following condition: the wall-thickness t1 of the outer peripheral blade part 13*d*<the wall-thickness t2 of the inner peripheral side blade part 13*e*, the height H of the step 13*c* made by the wall-thickness difference between the inner peripheral side blade part 13*e* and the outer peripheral blade part 13*d* on the blade dividing line B becomes gradually larger from the side plate 11 toward the main plate 12.

Furthermore, as described above, the blade shape is configured so that the step 13*c* existing along the blade dividing line B becomes larger in the distance from the rotation axis 0, from the section taken along the c-c line toward the section taken along the a-a line.

In the side plate 11, a side plate suction part 11*a* having a straight pipe shape and the airflow guide wall 11*b* for guiding suction flow to the blade 13 at its connection part with the blade 13, are connected, and this connection part 11*c* has a plane perpendicular to the rotation axis.

In such an air conditioner, upon turning-on the fan motor 7, the centrifugal fan 8 is rotationally driven, so that air in the room 9 is sucked from the ceiling suction port 10 to the space behind the ceiling 9*b* and passes through the body side-plate side suction port 1*a* and the body top plate-side suction port 1*d*; dust, smell and the like have been removed from the room 9 and the space 9*b* behind the ceiling by the dust removal filter 2, to thereby make air cleaning; and then, the air is subjected to cooling, heating, or dehumidification by the heat exchanger 3, and sucked into the centrifugal fan 8. Thereafter, the flow blown off from the centrifugal fan 8 is subjected to forced air-direction control to move the flow toward obliquely downward direction by the airflow guide plate 6, and the air is blown off from the blowoff port 4*a* of the body panel 4 provided at a lower part of the body 1, whereby the room 9 is air-conditioned.

Figure 14:
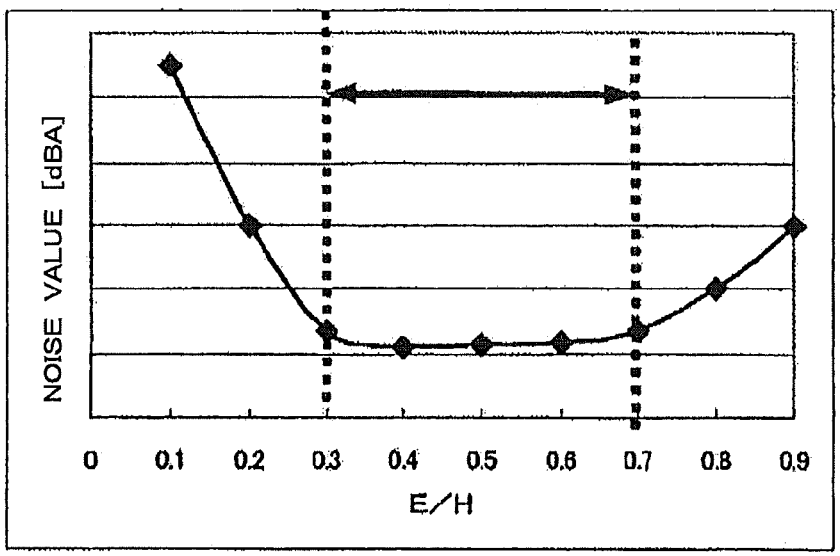
FIG. 14 is a graph showing the relationship between the ratio (E/H) of the distance E from a bell mouth 6*a* to a top plate 1*c* with respect to the body height H, and the noise value under the same air mount condition.

The bell mouth 6*a* of the airflow guide plate 6 and the body top plate 1*c* are provide so as to be spaced apart by a predetermined distance (E) from each other. If this distance is too small, the flow accelerates between the bell mouth 6*a* and the body top plate 1*c*, and drift resistance increases, so that it is necessary to increase the fan revolution number in order to blow a required amount of air. As a consequence, the relative speed with respect to the blades increases, resulting in increased noises. Hence, there exists an applicable range for the distance E between the bell mouth 6*a* and the body top plate 1*c*. FIG. 14 is a graph showing the relationship between the ratio (E/H) of the distance E from the bell mouth 6*a* to the top plate 1*c* with respect to the body height H, and the noise value under the same air mount condition. As shown in FIG. 14, if the E/H is smaller than 0.3, the effect of the draft resistance increase is large and noises sharply increase. On the other hand, if the E/H is larger than 0.7 and the body height is the same, the centrifugal fan becomes low-profile and an increase in a total pressure decreases, so that the fan revolution number increases, resulting in increased noises. In a case of a different body height, the body height becomes large, leading to a reduction in workability. Therefore, the value of E/H=0.3 to 0.7 allows low noise and size-reduction without reducing installation place.

The air conditioner 1 of the present invention can have the body suction port 1*d* in the body top plate 1*c*, in addition to the body suction port 1*a* in the body side-wall 1*b* on the upstream side of the heat exchanger 3, and can have the filter 2 so as to completely cover the top plate side suction port 1*d*, and side-plate side suction port 1*a*. By such arrangements, the suction port area and the dust removal filter area can be increased, thereby allowing a reduction in draft resistance and noises. Further, a time interval between filter cleaning operations can be elongated, and hence the number of cleaning operations can be reduced, whereby an air conditioner with low noise and maintenance saving property can be achieved.

Figure 23:
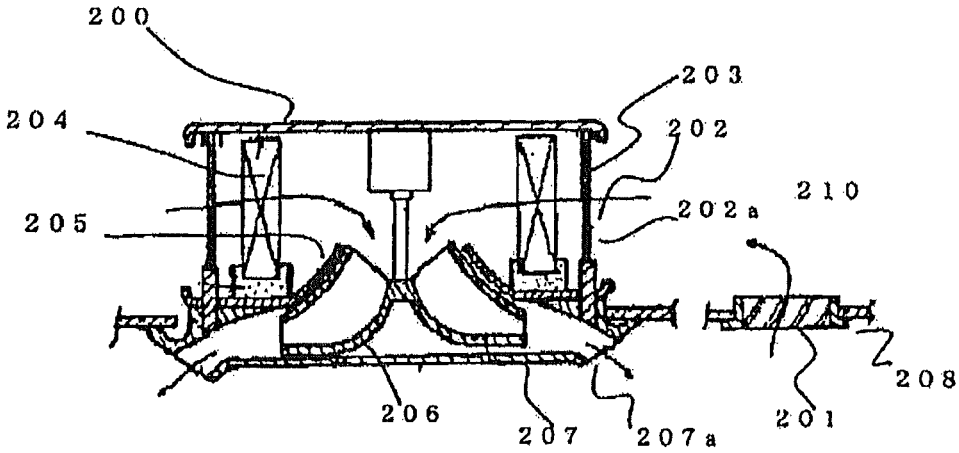
FIG. 23 is a longitudinal sectional view of a conventional ceiling-embedded air conditioner.

FIG. 23 is a longitudinal sectional view of a mixed flow turbo fan in the Patent Document 1. In FIG. 23, at a position apart from an air conditioner body 200 in a ceiling 208, there is provided a ceiling surface suction port 201 for sucking indoor air in a room 221 into a space 210 behind a ceiling, a body suction port 202*a* is provided in a body side-wall 202, a filter 203 is provided to the body suction port 202*a*, and a heat exchanger 204 is arranged behind the body suction port 202*a* so as be opposed to the body suction port 202*a*. A blower 206 is provided in a space surrounded by an airflow guide plate 205 and a ceiling panel 207. In the ceiling panel 207 mounted under the body 200, a ceiling panel blowoff port 207*a* alone is provided.

The conventional air conditioner is configured in this way. Since the direction of blowoff air from the centrifugal fan is a horizontal direction perpendicular to an axis, when a centrifugal fan is installed within the air conditioner body, blowoff flow on the side-plate side and that on the main plate side interfere with each other to thereby enhance a draft resistance and increase noises. As a result, the fan has to be installed to protrude downward from the air conditioner body. It is required, therefore, that the ceiling panel is disposed in a state of protruding from the ceiling surface, which makes the size-reduction of the apparatus difficult, and gives feeling of oppression to people in the room provided with the air conditioner.

However, in the centrifugal fan of this embodiment, a fan blowoff flow is blown off in an oblique direction. In the case where the fan blowoff flow is blown off in the radial direction of the fan as in conventional centrifugal fans, a ceiling panel blowoff port has a horizontal blow configuration, and therefore, below the ceiling panel, the air-conditioned air cannot be blown. In contrast, in the present invention, high comfortability can be obtained everywhere. Also, air is blown off from the ceiling panel in an oblique direction by the airflow guide plate, thereby suppressing the increase in blowoff draft resistance.

Furthermore, since there is no need to arrange the blowoff port of the fan to protrude downward from the body as in the case of the conventional centrifugal fans, the main plate 12, which is the bottom surface of the centrifugal fan 8, and the end of the blowoff port 6*b* of the airflow guide plate 6 can be disposed at higher places than the ceiling. This facilities size reduction, and does not give feeling of oppression to people in the room provided with the air conditioner.

Figure 12:
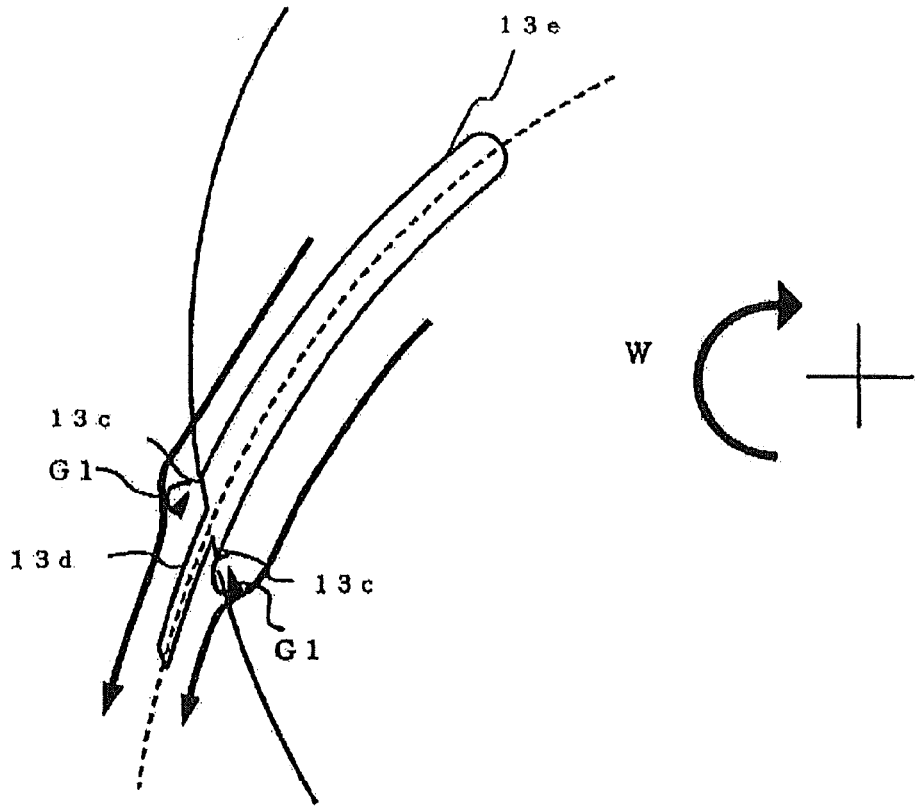
FIG. 12 is a diagram showing flow in the vicinity of blade step 13*c* in FIG. 9.

When air is blown off from the inner peripheral side of the blade 13 toward the outer peripheral side thereof at the step 13*c* formed by the wall-thickness difference between the inner peripheral side blade part 13*e* and the outer peripheral side blade part 13*d*, vortexes G1 are generated and a negative pressure occurs, as shown in FIG. 12 illustrating a flow in the vicinity of the blade level difference 13*c* shown in FIG. 9. As a result, the flow having passed on the inner peripheral side blade part 13*e* flows along the outer peripheral blade part 13*d*, to thereby allow prevention of occurrence of flow separation, and reduces flow separation which is generated at blade rear edge part 4*d* without the step, to thereby suppress disturbance, leading to a reduction in noises.

Figure 13A:
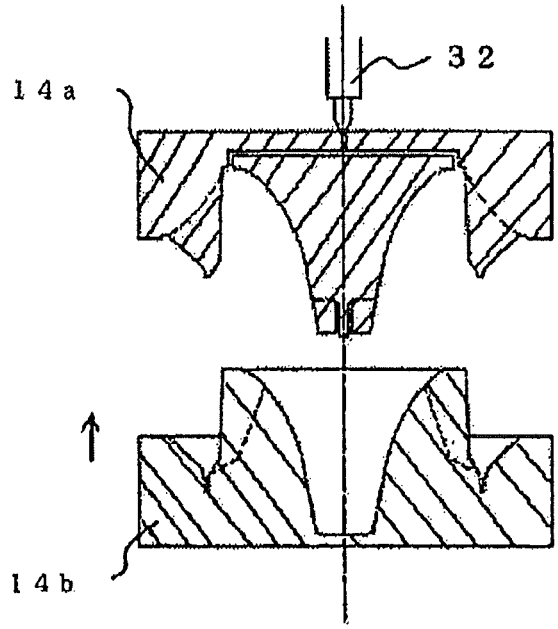
FIG. 13A is a diagram showing an outline of a molding method (first half).
Figure 13A:
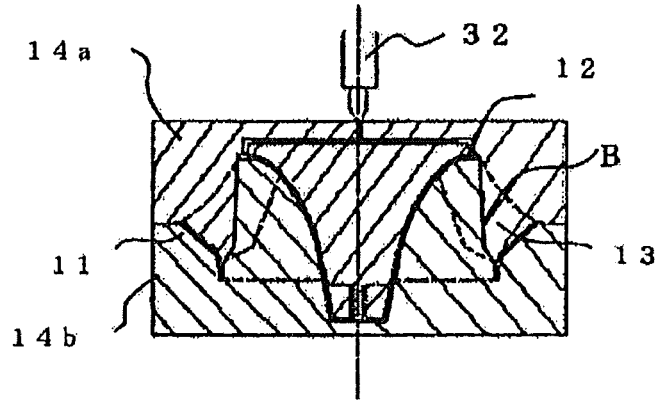
Figure 13A:
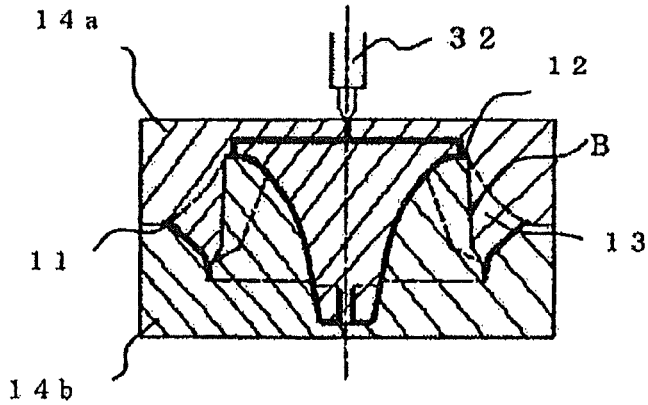
Figure 13B:
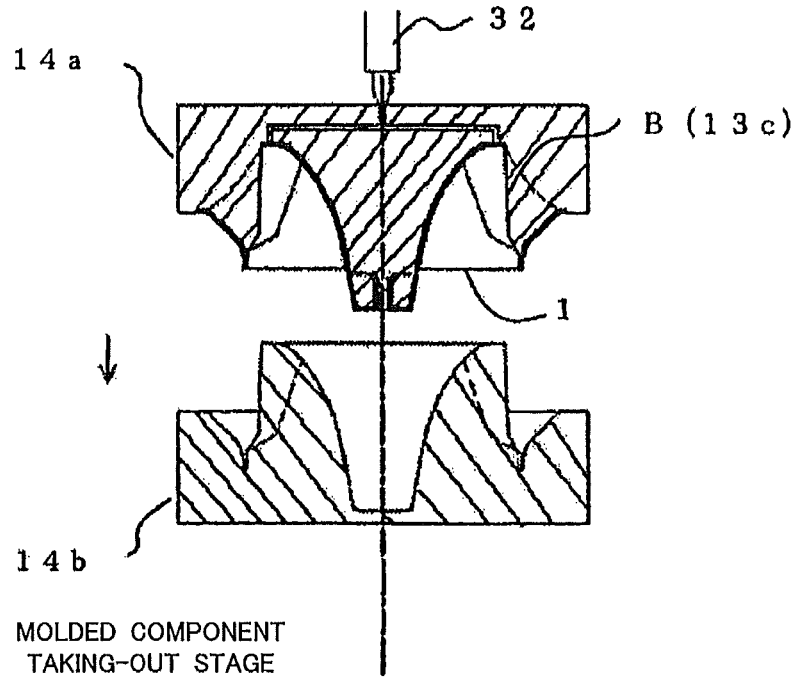
FIG. 13B is a diagram showing an outline of a molding method (second half).
Figure 13B:
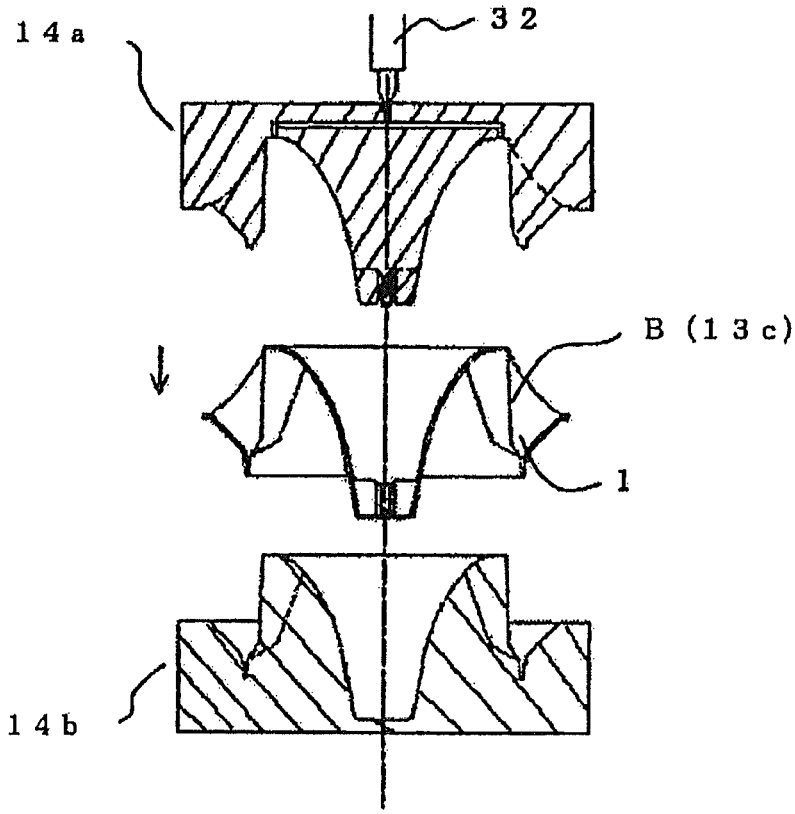

FIGS. 13A and 13B are diagrams showing each stage in molding processing. The centrifugal fan of the first embodiment are molded through the following stages: (a) a mold moving stage, (b) a resin injection stage, and (c) a resin cooling stage, as shown in FIG. 13A; and (d) a mold release stage, and (e) a molded component taking-out stage as shown in FIG. 13B.

(a) In the mold moving stage, toward a mold 14*a*, another mold 14*b* moves and comes into close contact with the mold 14*a*. To the mold 14*a*, an injection nozzle 32 for injecting a thermoplastic resin such as ABS, AS, PP, or PS is fixed. (b) In the resin injection stage, the above described resin is injected from the injection nozzle 32 into a gap formed between the molds 14*a* and 14*b* being in a close contact with each other. The resin flows in from the main plate 12 to the boss 12*a*, and from the main plate 12 through the blade 13 to the side plate 11. Then, (c) in the resin cooling stage, the mold is cooled and the centrifugal fan 1 is formed. Thereafter, (d) in the mold release stage, the mold 14*b* leaves the mold 14*a*. At this time, at closely contacting part between the molds 14*a* and 14*b*, positioned on the blade of the air conditioner body 1, the blade dividing line B, that is, the step 13*c* is formed. (e) In the molded component taking-out stage, the air conditioner body 1 as a molded component is taken out from the mold 14*a*, thus completing the molding.

As described above, by forming the step 13*c*, during molding, the mold 14*b* can move in the side plate (11) direction of the rotation axis, on the inner peripheral side from the level difference 13*c*, and also, on the outer peripheral side, by moving the mold 14*a* to the main plate (12) side direction of the rotation axis the work can be released, as shown in FIGS. 13A and 13B (mold outline diagrams). This eliminates the need for a slide mold that moves in the direction perpendicular to the rotational axis. As a result, the blade 13, the main plate 12, and the side plate 11 can be integrally molded into one unit, and the molding method becomes simple, so that a molding failure is less prone to be caused, leading to high reliability. Also, by rearrangement or the like, the amount of scrap materials can be suppressed, which is friendly to the environment.

Furthermore, as shown in FIG. 8, since the side plate recess part 11*c* has a plane perpendicular to the rotational axis, the joint surface between an upper and lower molds does not assume a sharply acute angular shape, and therefore, even if molding is successively performed, the mold is less prone to cause chipped edges of the mold, and hence, it is less prone to a breakdown, so that the number of additional productions of molds can be reduced, thereby allowing resource saving.

Moreover, at this time, since the vortexes G2 arise in the side-plate recess part and a negative pressure occurs, the flow having flowed-in from the side plate suction part 11*a* can flow along the airflow guide wall 11*b* preventing flow separation, so that even more noise reduction can be achieved.

When the air conditioner body and ceiling panel are separately transported, in the case where the conventional centrifugal fan is installed to protrude from the air conditioner body, there is possibility that the fan may suffer breakdown under shocks applied thereto at the time when the body is stacked up. Therefore, robust packing materials for covering the fan's portion protruding from the body are required. In contrast, in the present invention, since the centrifugal fan is accommodated within the body, simple packing is only needed, thereby allowing reduction in packing materials. Also, a fan breakdown can be less likely to occur, and transportation quality can also be enhanced.

Moreover, since there is no need for increase in installation height in a space behind the ceiling, and the ceiling panel can be substantially flush with the room side surface of the ceiling, that is, the fan does not protrude toward the room side unlike the conventional case, so that people in the room do not suffer feeling of oppression.

The airflow guide plate is integrally formed of the airflow guide part being formed into a truncated cone shape in a gradually enlarging manner so as to isolate the fan suction airflow path from the blowoff airflow path and to guide a fan blowoff flow to the outside of the machine, and of the bell mouth. Therefore, the fan suction flow is rectified, as well as the increase in draft resistance of the fan blowoff flow is suppressed, thereby preventing increase in noises. In addition, since the airflow guide wall and the bell mouth are integrated in one unit, work efficiency is high during assembly or disassembly for recycling, because of a low number of components.

As a consequence, a reduction in packing materials can be achieved by virtue of breakdown prevention during transportation of the centrifugal fan. This enhances transportation quality, and facilitates assembly/disassembly as well as improves recycling workability. Furthermore, since the blades, the main plate, and the side plate can be molded into one unit, the molding method is simplified, and molding failure is less prone to occur, thereby enhancing reliability. As a result, the amount of scrap materials due to rearrangement or the like can be suppressed, which is friendly to the environment. Moreover, residents do not suffer stresses due to feelings of oppression, and there are no temperature variations, leading to high comfortability. Thus, an air conditioner having low noise and high maintenance-saving properties can be obtained.

Second Embodiment

Figure 16:
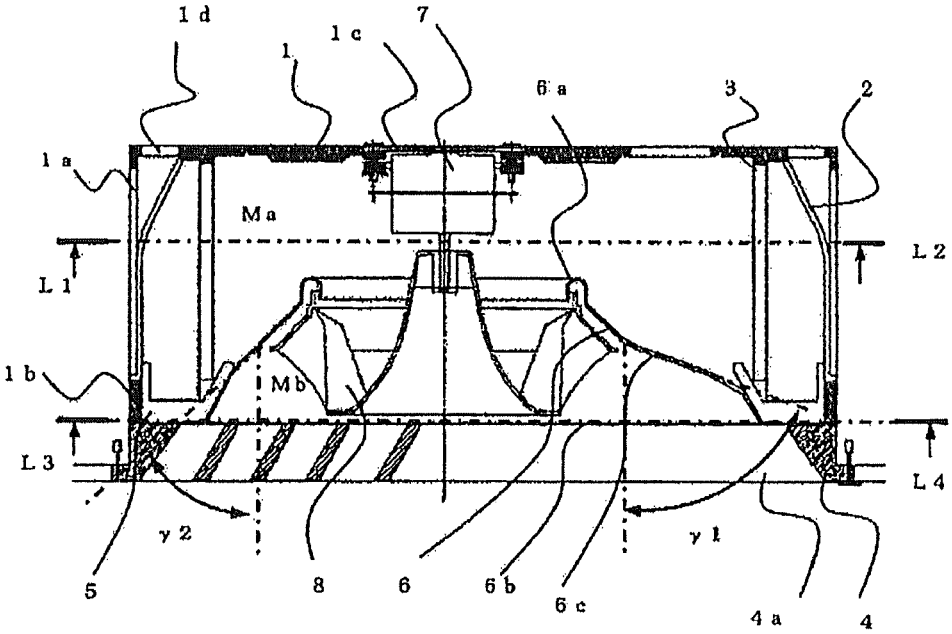
FIG. 16 is a longitudinal sectional view of the air conditioner taken along section indicating lines J1 to J3 in FIG. 14.
Figure 17:
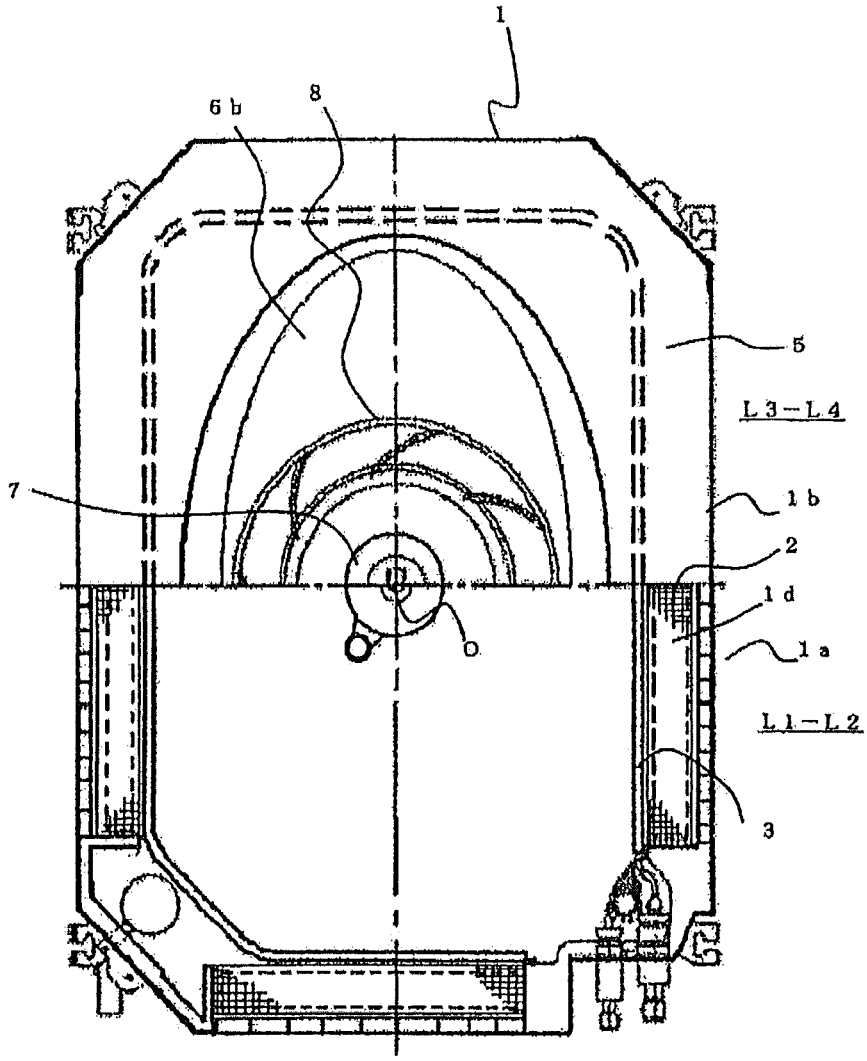
FIG. 17 is a horizontal sectional view at the height positions of L1-L2 and L3-L4 in FIG. 15, wherein the section at each of these two height positions is shown in a half in the illustration.

Hereinafter, an air conditioner according to a second embodiment of the present invention will be described with reference to FIGS. 15 to 17.

Figure 15:
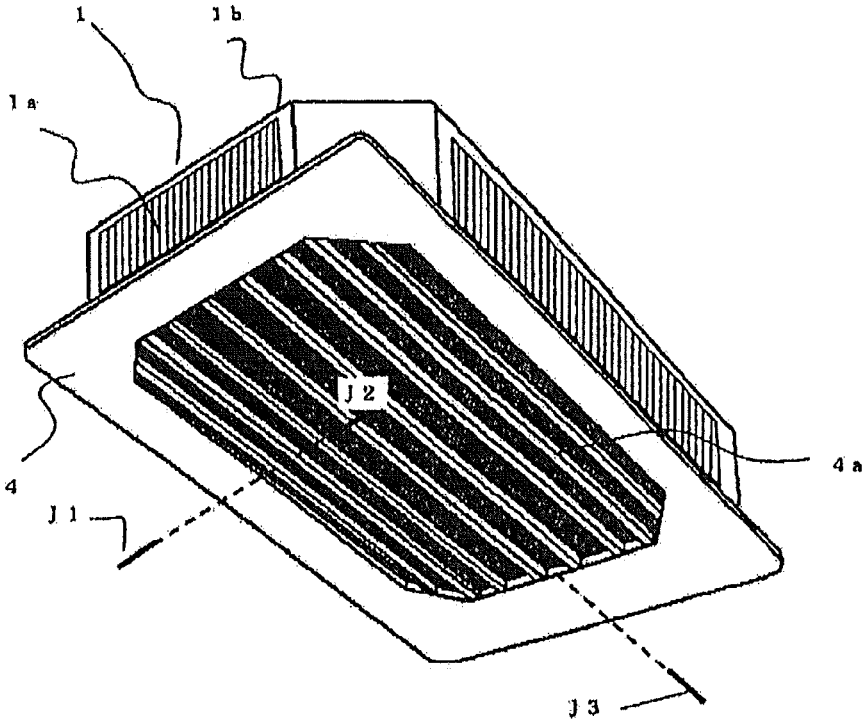
FIG. 15 is a perspective view, at the time of installation, of an air conditioner body and a ceiling panel of an air conditioner, according to a second embodiment of the present invention, the air conditioner being installed in a case where a room is elongate.

FIG. 15 is a perspective view of an air conditioner according to the second embodiment of the present invention, at the time when the air conditioner body and ceiling panel are installed; FIG. 16 is a longitudinal sectional view of the air conditioner taken along section indicating lines J1 to J3 in FIG. 15; and FIG. 17 is a horizontal sectional view at the height positions of L1-L2 and L3-L4 in FIG. 16, wherein the section at each of these two height positions is shown in a half in the illustration. In the second embodiment, regarding main constitution and corresponding symbols, the same ones as those in the first embodiment are used.

As shown in FIG. 15, the air conditioner body 1 has a rectangular parallelepiped and vertically long shape. Under the body 1, there is provided a body panel 4 having a rectangular shape. As shown in FIGS. 16 and 17, a body side-plate side suction port 1*a* is provided to a body sidewall 1*b*, and a body top plate-side suction port 1*d* is arranged along a body side-wall 1*b* of a body top plate 1*c*. A dust removal filter 2 is arranged so as to completely cover the body side-plate side suction port 1*a* and the body top plate-side suction port 1*d*, and a heat exchanger 3 is installed in an upright position on the downstream thereof along the side-wall 1*b*.

There is provided a fan blowoff airflow guide plate 6 that is integrally formed combination of an airflow guide part 6*c* and a bell mouth 6*a*, the airflow guide part 6*c* being formed into a truncated cone shape in a gradually enlarging manner so as to isolate a fan suction air path·Ma of a centrifugal fan 8 from a blowoff air path Mb thereof. The tilt angle y of the airflow guide part 6*c* of the fan blowoff airflow plate 6 is configured so that the angle y1 in the longer direction of the body 1 is larger than the angle y2 in the shorter direction thereof, and an airflow plate blowoff port 6*b* is formed into an ellipse shape, as shown in FIG. 16.

By forming the fan blowoff airflow plate 6 in this manner, even when the air conditioner body is formed into a vertically long shape because of limitations of an installation space such as an elongate room, a blowoff flow of the centrifugal fan reaches the body longitudinal direction, and is uniformly blown off from the ceiling panel blowoff port, so that unevenness temperature in the room can be suppressed, thereby allowing an enhancement of comfortability.

Third Embodiment

Hereinafter, an air conditioner according to a third embodiment of the present invention will be described with reference to FIGS. 18 to 20.

Figure 18:
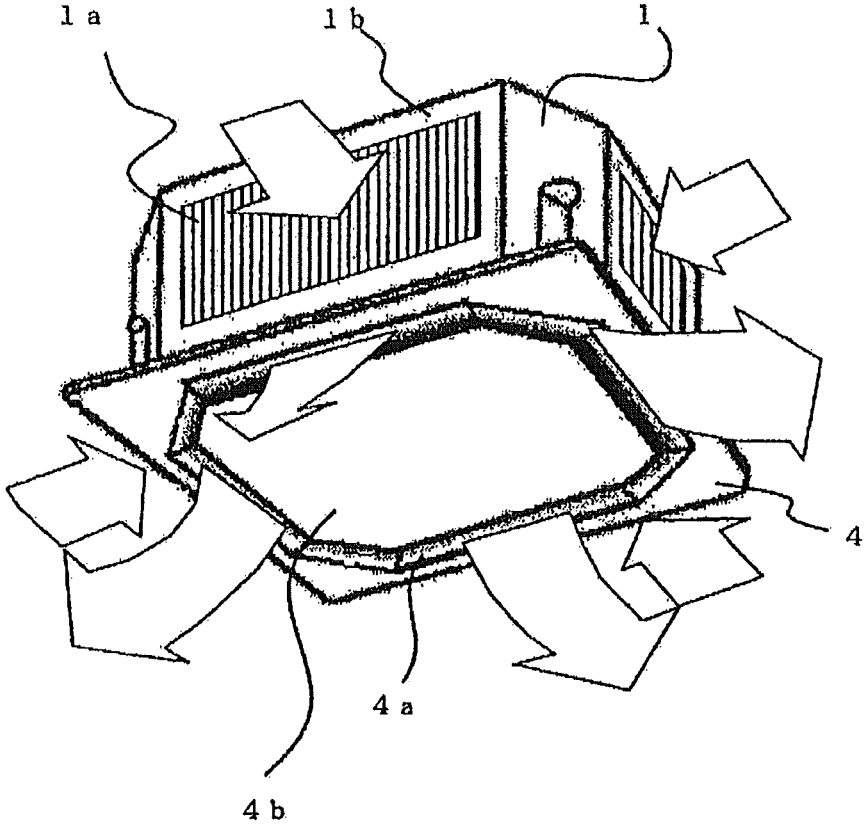
FIG. 18 is a perspective view, at the time of installation, of an air conditioner body and a ceiling panel of an air conditioner, according to a third embodiment of the present invention.

FIG. 18 is a perspective view of an air conditioner body and a ceiling panel at the time of installation, according to a third embodiment of the present invention; FIG. 19 is a longitudinal sectional view corresponding to FIG. 18; and FIG. 20 is a horizontal sectional view taken along section indicating lines k1 to k4 in FIG. 19. In the third embodiment, regarding main constitution and corresponding symbols, the same ones as those in the first embodiment are used. In FIG. 18, the body panel 4 is configured so that its blowoff port 4*a* is opened in a substantially square shape and that the centrifugal fan 8 becomes less visible from directly below the body panel 4 due to the central panel 4*b* in the central part.

Figure 19:
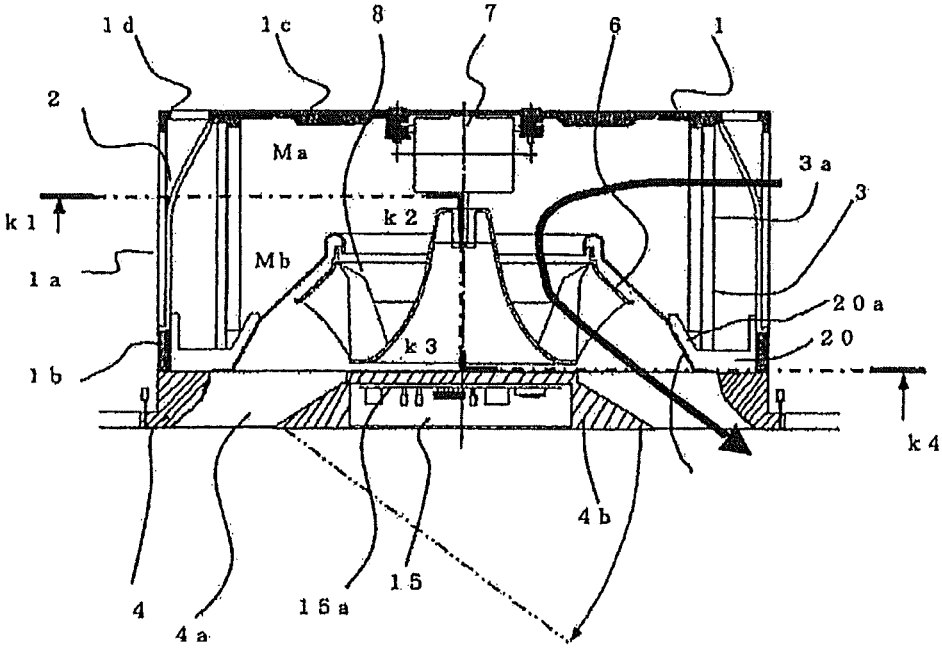
FIG. 19 is a longitudinal sectional view corresponding to FIG. 17.

As shown in FIG. 19, an outer frame of the body panel 4 is fixed to the air conditioner body 1 to thereby constitute a bottom surface of the body, and a central panel 4 in the central part of the body panel 4 is configured so as to be capable of opening and closing or hinges and being removed. Inside the ceiling panel 4, there is provided an electrical component box for accommodating electrical components such as an electrical substrate 15*a* for the power supply to a fan motor 7, revolution number control, and the exchange of control signals with an outdoor machine (not shown).

Furthermore, the airflow guide plate 6 that is integrally formed of the airflow guide part 6*c*, which is formed into a truncated cone shape in a gradually enlarging manner so as to isolated a fan suction air path Ma from a blowoff air path Mb and to guide a fan blowoff flow to the outside of the machine, and the bell mouth 6*a*, and the centrifugal fan are small relatively to a ceiling panel central opening 4*c* at the time when the central panel 4*b* is removed. Therefore, the airflow guide plate 6 and the centrifugal fan 8 can be removed from the body panel central opening 4*c*.

A side wall 5*a* of a drain pan 5 has a tilt shape along the tilt shape airflow guide part 6*c* of the fan blowoff airflow guide plate 6. Here, in the air conditioner 1 of the third embodiment, there are provided a plurality of columns of the heat exchangers 3. The upper end parts of the heat exchangers 3 are flush with each other, and that the lower end parts thereof are arranged in a staircase pattern along the tilted side wall of the drain pan. As a result, even though the column direction width increases by forming the plurality of columns of heat exchangers, the body size does not increase, and can be still kept compact.

By forming the ceiling-embedded air conditioner in this manner, since the blowoff port of the ceiling panel is opened in a substantially square shape, the centrifugal fan is invisible from people directly below the ceiling panel 4, leading to a favorable design. Also, since air is blown, off all around, unevenness of temperature in the room are suppressed to thereby enhance comfortability. Even if the opening shape is changed to a substantially circle shape, similar effects can be obtained.

Since the outer frame of the ceiling panel is fixed to the body to thereby constitute a bottom surface of the body, and the central part of the ceiling panel is capable of being removed, even at the time when the centrifugal fan is cleaned or the fan motor goes out of order, work can be performed without removing the airflow guide plate, thus improving work efficiency of cleaning, repair, or the like.

Moreover, since the central part of the ceiling panel is made an electrical component box for accommodating electrical components such as a substrate and the like, even if wiring or a substrate of electrical components goes out of order, work can be performed without removing components within the body, thus improving work efficiency of repair.

Also, since there is no electrical component in air paths, neither reduction in air paths on the suction side and the blowoff side, nor increase in draft resistance occur, thereby allowing low noise to be kept.

Furthermore, the airflow guide plate that is integrally formed of the air guide part which is formed into a truncated cone shape in a gradually enlarging manner so as to isolated the fan suction air path from the fan blowoff air path and to guide a fan blowoff flow to the outside of the machine and the bell mouth, and the centrifugal fan are small relatively to the ceiling panel central opening at the time when the ceiling panel central part is removed, and the airflow guide plate and the centrifugal fan can be removed from the ceiling panel opening part. Therefore, when attempting to clean the inside of the body, there is no need for removal of the ceiling panel, thereby facilitating cleaning.

As a result, a ceiling-embedded air conditioner with low noise and high maintenance saving properties can be obtained.

Figure 20:
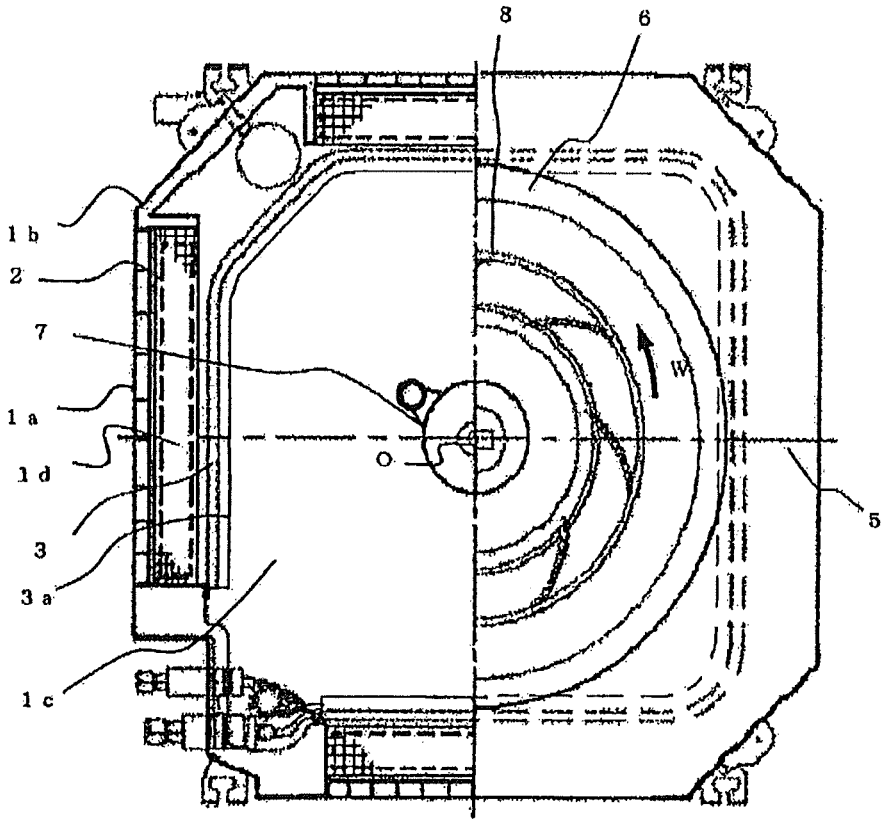
FIG. 20 is a horizontal sectional view taken along section indicating lines k1 to k4 in FIG. 18.
Figure 21:
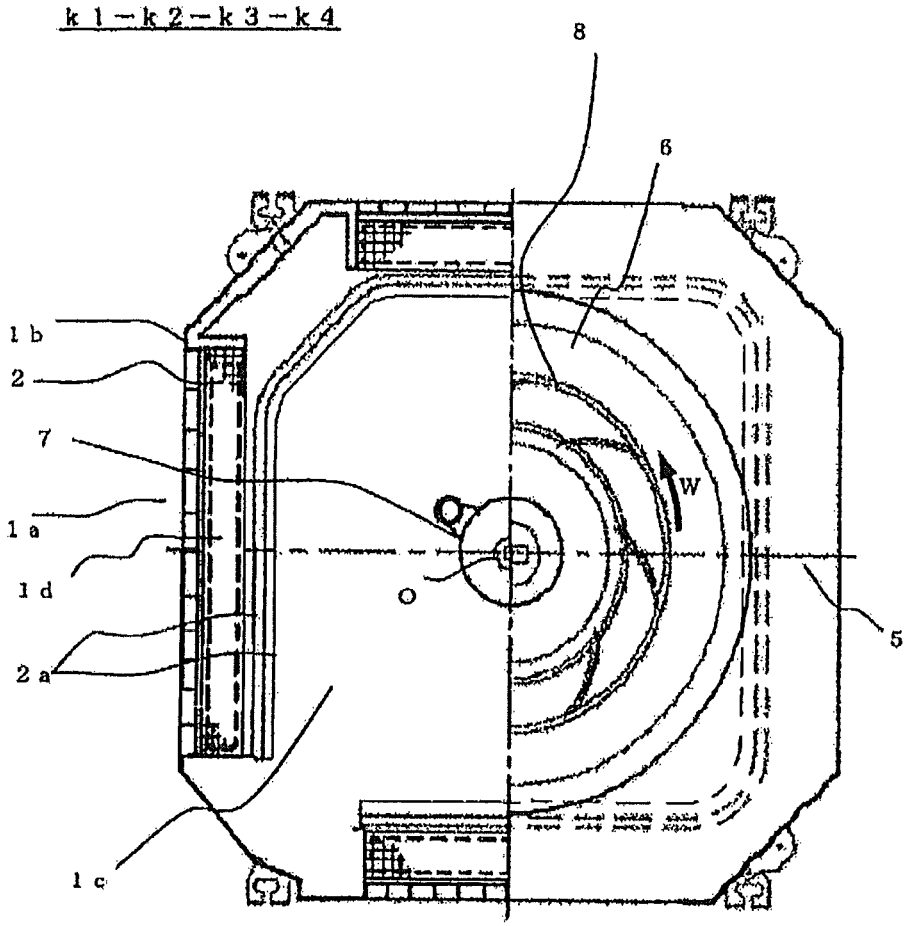
FIG. 21 is a horizontal sectional view corresponding to FIG. 19 at the time when a heat exchanger is replaced with an air cleaning filter.

As shown in FIG. 21, when all of the heat exchangers 3, or the heat exchangers 3 on the upstream side as shown in FIG. 20 is changed to an air cleaning filter 2*a*, small and dust can be removed, thereby allowing the room and the space behind the ceiling to be always kept in sanitary conditions.

Figure 22:
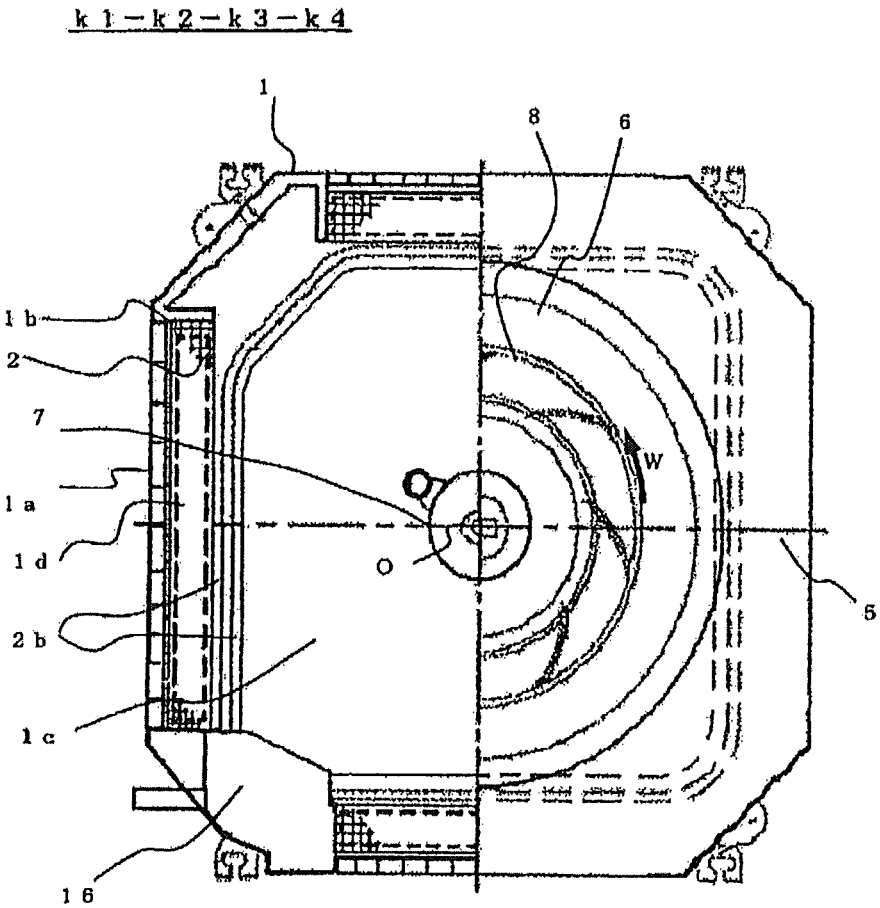
FIG. 22 is a horizontal sectional view corresponding to FIG. 19 at the time when a heat exchanger is replaced with a humidifying filter.

As shown in FIG. 22, when all of the heat exchangers 3, or the heat exchanger 3 on the upstream side as shown in FIG. 20 is changed to an humidifying filter 2*b*, a humidification tank 16 for temporarily storing water of water piping connected from outside of the body 1 is arranged at a corner portion where a humidifying filter 2*b* of the body 1 is not provided, the temperature in the room can always be kept constant.

The invention claimed is:

1. An air conditioner comprising:

an air conditioner body provided on a ceiling in a room to be air-conditioned;

a ceiling panel having a blowoff port for blowing off air from an inside of the air conditioner body;

a side wall installed in an upright position along an outer periphery of the ceiling panel;

an air conditioner top plate provided so as to cover a surface opposed to the ceiling panel with respect to the side wall;

a body suction port formed in the side wall of the air conditioner body;

a heat exchanger provided in a vicinity of the body suction port, inside the side wall;

a fan motor fixed to the air conditioner top plate, the fan motor having a rotational shaft;

a centrifugal fan having a convex-shaped boss part fixed to the rotational shaft of the fan motor, the centrifugal fan sucking the air via the body suction port and the heat exchanger and blowing off the air to the room as a result of the rotation of the rotational shaft; and an airflow guide plate integrally formed by a bellmouth part and an airflow guide part, wherein the air passing through the heat exchanger is taken into the bellmouth part, and the airflow guide part guides the air sucked via the body suction port and the heat exchanger to the blowoff port of the ceiling panel, the airflow guide part being formed into a truncated cone shape in a gradually enlarging manner toward the blowoff port of the ceiling panel, wherein the airflow guide plate and the centrifugal fan are removable.

2. The air conditioner of claim 1, wherein the ceiling panel is located substantially in the same surface as the surface on the room of the ceiling.

3. The air conditioner of claim 1, wherein the centrifugal fan comprises:

a main plate having a flat part provided on an outer peripheral side thereof, and a boss part provided at a central part thereof;

a side plate having an airflow guide wall provided so as to surround the boss part with a predetermined distance therebetween; and a plurality of blades provided between the main plate and the side plate so as to be substantially orthogonal to a plane perpendicular to a rotational axis; and wherein, with rotation of the plurality of blades, the centrifugal fan blows air from a suction port formed of a boss-side wall surface and an end part of the side plate opposite to the boss-side wall surface, toward the blowoff port formed of an outer peripheral side flat part of the main plate and an end part of the side plate opposite to the outer peripheral side flat part;

wherein, an edge part of the blade positioned on the downstream side of a blowing direction is taken as a blade rear-edge part and the centrifugal fan has the following relationship:

outer diameter of the side plate>outer diameter of the blade rear-edge part on a side-plate side>diameter of the blade rear-edge part on a main plate side>outer diameter of the main plate;

wherein the blade rear-edge part is positioned inside from a straight line connecting a connection point between the blade rear-edge part and the main plate, to a connection point between the blade rear-edge part and the side plate, as viewed from the rotational axis side; and wherein the blade rear-edge part has a shape such that the distance from the rotational axis becomes larger from the main plate toward the side plate.

4. The air conditioner according to claim 1, wherein a ratio (E/H) of a distance E of a closest approach between the bell mouth part and the body top plate to a body height H is set to 0.3 to 0.7.

5. The air conditioner according to claim 1, wherein a further body suction port is formed in the body top plate on the upstream side of the heat exchanger; and wherein a filter is provided so as to cover the suction port formed on the top plate and the side wall.

6. The air conditioner according to claim 3, wherein a wall thickness of an outer peripheral side blade part located on the outer peripheral side from a blade dividing line connecting the connection point between the rear-edge part of the blade and the main plate, and the connection point between the front-edge part thereof, and the side plate, is smaller than that of an inner peripheral side blade part; and wherein a step is formed between the outer peripheral side blade part and the inner peripheral side blade part.

7. The air conditioner according to claim 6, wherein the wall thickness of the outer peripheral side blade part located on the outer peripheral side from the blade dividing line becomes larger from the main plate toward the side plate, and conversely, the wall thickness of the inner peripheral side blade part located on the inner peripheral side from the blade dividing line becomes smaller from the main plate toward the side plate; and wherein the blade is configured so that the step formed by the wall-thickness difference between the inner peripheral side blade part and the outer peripheral side blade part, becomes larger from the side plate toward the main plate.

8. The air conditioner according to claim 7, wherein the air conditioner has the following relationship: a diameter on the blade rear-edge part on main plate side<a diameter of the blade front-edge part on side-plate side; and wherein the blade dividing line is configured so that the distance between a point on the blade dividing line and the rotational axis is positioned at least between a radius on the blade rear-edge part on main plate side and a radius of the blade front-edge part on side-plate side, and that the distance to the rotational axis becomes larger from the main plate toward the side plate.

9. The air conditioner according to claim 1, wherein the air conditioner body has an elongated shape in a horizontal section thereof;

wherein the heat exchanger has a rectangular section substantially along the side wall;

wherein the air guide wall of the fan blowoff airflow guide plate is configured so that a tilt angle thereof is larger in a longer direction of the heat exchanger than in a shorter direction thereof, and an airflow guide plate blowoff port is formed into an ellipse shape.

10. The air conditioner according to claim 1, wherein the blowoff port in the ceiling panel has an opening with a substantially square shape or round shape.

11. The air conditioner according to claim 9, wherein an outer frame of the ceiling panel is fixed to the body to thereby constitute a bottom surface of the body; and wherein a central part of the ceiling panel is configured to be removable.

12. The air conditioner according to claim 9, wherein a central part of the ceiling panel is made an electrical component box arranged to accommodate electrical components.

* * * * *